US005476703A

United States Patent [19]

Wattel et al.

[11] Patent Number: 5,476,703

[45] Date of Patent: Dec. 19, 1995

[54] METHOD FOR FORMING A SEMIFINISHED NONWOVEN PRODUCT AND A SEMIFINISHED NONWOVEN PRODUCT

[75] Inventors: Jean-René Wattel; Jean-Christophe Laune; Bernard Jourde, all of Elbeuf, France

[73] Assignee: Asselin (Societe Anonyme), Elbeuf, France

[21] Appl. No.: 977,400

[22] PCT Filed: Jun. 26, 1992

[86] PCT No.: PCT/FR92/00602

§ 371 Date: Mar. 1, 1993

§ 102(e) Date: Mar. 1, 1993

[87] PCT Pub. No.: WO93/00464

PCT Pub. Date: Jan. 7, 1993

[30] Foreign Application Priority Data

Jun. 28, 1991 [FR] France ..... 91 08049

[51] Int. Cl.[6] ..... B32B 5/12; D04H 1/58

[52] U.S. Cl. ..... 428/113; 19/163; 19/161.1; 428/288; 428/292; 428/293; 428/294

[58] Field of Search ..... 428/224, 288, 428/292, 293, 294, 113; 19/161.1, 163

[56] References Cited

U.S. PATENT DOCUMENTS

| | | | |
|---|---|---|---|
| 3,682,734 | 8/1972 | Burger | 19/16.3 |
| 4,910,064 | 3/1990 | Sabee | 428/294 |
| 5,182,835 | 2/1993 | de Giudici | 19/163 |
| 5,239,734 | 8/1993 | Bathelier et al. | 28/107 |

FOREIGN PATENT DOCUMENTS

| | | |
|---|---|---|
| 0129516 | 12/1984 | European Pat. Off. . |
| 2649130 | 1/1991 | France . |

*Primary Examiner*—George F. Lesmes
*Assistant Examiner*—K. Shelborne
*Attorney, Agent, or Firm*—Young & Thompson

[57] ABSTRACT

A lap is produced in a spreading lapping machine (2) by successively folding a fiber web from a card (1), whereafter the lap is drawn in a drawing machine (4). The drawing machine (4) is provided with rotatable devices having peripheral fittings with spikes that are driven into the core of the lap. The degree of drawing is adjusted in such a way that most fibers in the drawn product are arranged in two directions which are substantially symmetrical relative to the lengthwise direction of said drawn product, and lie at an angle of 30°–60° C. relative thereto. The method is particularly useful for improving the mechanical properties of lapped products.

9 Claims, 2 Drawing Sheets

METHOD FOR FORMING A SEMIFINISHED NONWOVEN PRODUCT AND A SEMIFINISHED NONWOVEN PRODUCT

The present invention relates to a method for forming a semifinished nonwoven product.

This invention also relates to a semifinished nonwoven product which can be obtained by this method.

In the field of nonwoven fabrics, it is known to obtain laps by means of a spreading and lap-forming machine in which a web delivered by a card is folded in zigzag pleats. The lap has a relatively substantial thickness and a known practice consists in drawing it out in order to reduce its weight per square meter at the exit of the spreading and lap-forming machine. However, the product thus obtained is delivered by the drawing frame at a speed which is often considerably higher than that of machines used for subsequent processing of the product such as, for example, machines for forming transverse rows of stitches in order to consolidate the product, or else carpet machines. It is admittedly possible to some extent to operate the card and the spreading and lap-forming machine as well as the drawing frame at a low speed but their efficiency may thus be impaired. Be that as it may, the large capital investment involved in machines of this type would not in such a case be put to good use.

Patent document EP-A-0,129,516 describes a drawing frame having rollers each provided with a resilient peripheral covering consisting of teeth which are intended to bend in contact with the lap in order to prevent the formation of holes in the drawn-out lap. This resilient covering improves the grip of the rollers on the lap but does not in any way solve the speed problems mentioned earlier.

Patent document FR-A-2,649,130 describes a method for manufacturing textile products such as carpets from a web of fibers. A first mechanism places the fibers of the web in preferred orientations. The fibers thus oriented are immediately delivered to a second mechanism which manufactures the carpet. The fibers thus oriented do not constitute a coherent semifinished product but form an ephemeral material which cannot be coiled or stored and is obtained without either a spreading and lap-forming machine or a drawing frame.

The object of the present invention is to overcome these various disadvantages and difficulties of operation.

In accordance with the invention, the method for forming a semifinished nonwoven product in which a lap is formed by successively folding a web of fibers delivered by a card, said lap being then drawn-out in a drawing frame, essentially involves the use of a drawing frame equipped with rollers each provided with a peripheral covering having teeth which are caused to penetrate to the heart of the lap, and in so adjusting the degree of draft that the majority of the fibers within the drawn product are distributed in two orientations which are substantially symmetrical with respect to the longitudinal direction of the drawn product and which form with this direction an angle within the range of 30° C. to 60° C.

There is thus obtained, surprisingly, a semifinished product having two very privileged orientations of fibers which are preferably substantially perpendicular to each other and at 45° C. to the longitudinal direction of the product. The expression "very privileged orientation" is understood to mean that a majority of fibers has either of these two orientations. This is surprising because, as a general rule, the fibers of products which are drawn-out after lap formation have practically a random orientation.

Moreover, the semifinished product obtained offers particularly advantageous characteristics. Considering the fact that the product has simply been drawn-out after lap formation, it has an astonishing degree of cohesion. It can thus be coiled as it passes out of the drawing frame, then uncoiled prior to use in production lines for subsequent processing. At the time of uncoiling, it is observed that the fibers of the different turns have practically not interpenetrated and mixed at the time of storage in the coiled state.

The semifinished product in accordance with the invention can thus be produced at high speed and can form coils which serve to supply a plurality of production lines operating in parallel and at lower speeds for subsequent processing.

Moreover, a surprising result for this type of intermediate product is that the product thus obtained has a resistance in the longitudinal direction which is of the same order of magnitude as (and may in fact be higher than) the resistance to pulling stress in the transverse direction. This is particularly favorable for subsequent processing of the semifinished product since the majority of processing lines subject the semifinished product to high longitudinal pulling stress which is liable to become critical if the product is too weak.

It appears that the surprising number of advantages offered by the invention is due to the fact that the roller coverings of the drawing frame perform homogeneous drawing-out,of the entire thickness of the lap and at the same time perform needle-punching of the lap, which tends to interlock the fibers and to subject them all to the same change of orientation with respect to the orientations defined by the spreading and lap-forming machine.

It is observed in addition that the drawing operation in accordance with the invention is accompanied by only slight transverse shrinkage. In other words, the semifinished product has a width which is only slightly reduced with respect to the exit width of the spreading and lap-forming machine. Transverse shrinkage usually has the effect of modifying the orientation of the fibers and of making it irregular. By virtue of the small degree of transverse shrinkage, the invention achieves good uniformity of manufacture both in regard to the width of the semifinished product, its uniformity in weight per unit area, and the orientation of its fibers.

Generally speaking, the semifinished product has excellent weight uniformity, which is advantageous in view of the fact that the manufacturer of a textile product has to guarantee a minimum weight and any irregularities of manufacture consequently make it necessary to increase the average weight of the product in order to be able to guarantee the minimum weight.

In accordances with a second object of the invention, the semifinished nonwoven product is essentially composed of a coherent assembly of fibers, the majority of which are distributed in two orientations which are substantially symmetrical with respect to the longitudinal direction of the product and which form with this direction an angle within the range of 30° C. to 60° C.

This product can in particular be obtained very economically by means of a method in accordance with the first object.

Other features and advantages of the invention will appear from the following description, taken in connection with non-limiting examples.

Figure 1:
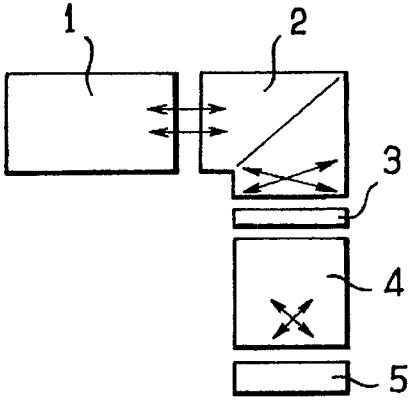
FIG. 1 is a schematic view of an installation for forming the semifinished product in accordance with the invention.

The method in accordance with the present invention is carried out by means of the installation shown in FIG. 1. This installation comprises, in series, a card 1, a spreading and lap-forming unit 2, a selvedge-teaser 3, a lap-drawing unit 4, and a roller 5 which collects the semifinished product.

Figure 4:
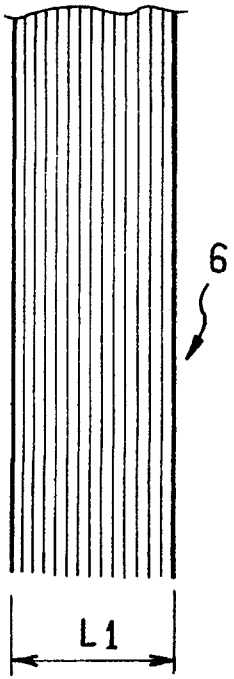

The card 1 produces a web of fibers 6 having a width L1 (as shown in FIG. 4). The fibers of the web 6 are essentially oriented in a direction which is substantially parallel to the longitudinal direction of the web 6.

Figure 5:
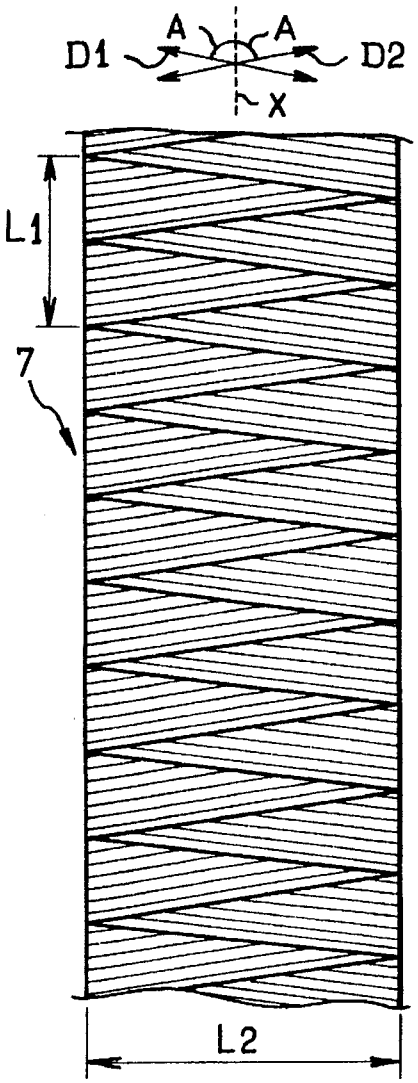

The spreading and lap-forming unit 2 is supplied with said web 6 which is delivered by the card 1. As shown in FIG. 5, a lap 7 is formed in known manner by the spreading and lap-forming unit 2 by successively folding the web 6. Said lap 7 is made up of superposed sections of web delimited by alternate pleats which define the lateral edges of the lap 7. These alternate pleats are relatively displaced in a direction parallel to the longitudinal direction X of the lap 7, with the result that the majority of the fibers in the lap 7 are distributed in two orientations D1, D2 which are symmetrical with respect to the longitudinal direction X of the lap 7. These majority orientations D1, D2 in the lap 7 form with its longitudinal direction X an angle A which is smaller than 90° and usually fairly close to this value (typically 75°<A<90°). This angle can be chosen in known manner by adapting the adjustments of the spreading and lap-forming unit 2. In the example illustrated in FIGS. 4 and 5, the spreading and lap-forming machine 2 has been so adjusted that the lap 7 has four layers of web 6. Thus the successive pleats located on one and the same lateral edge of the lap 7 are relatively displaced by one-half the width L1 of the web 6 delivered by the card 1.

At the exit of the spreading and lap-forming unit 2, the lap 7 passes into a selvedge-teaser 3 which teases the lateral edges of the lap 7 in known manner.

Figure 6:
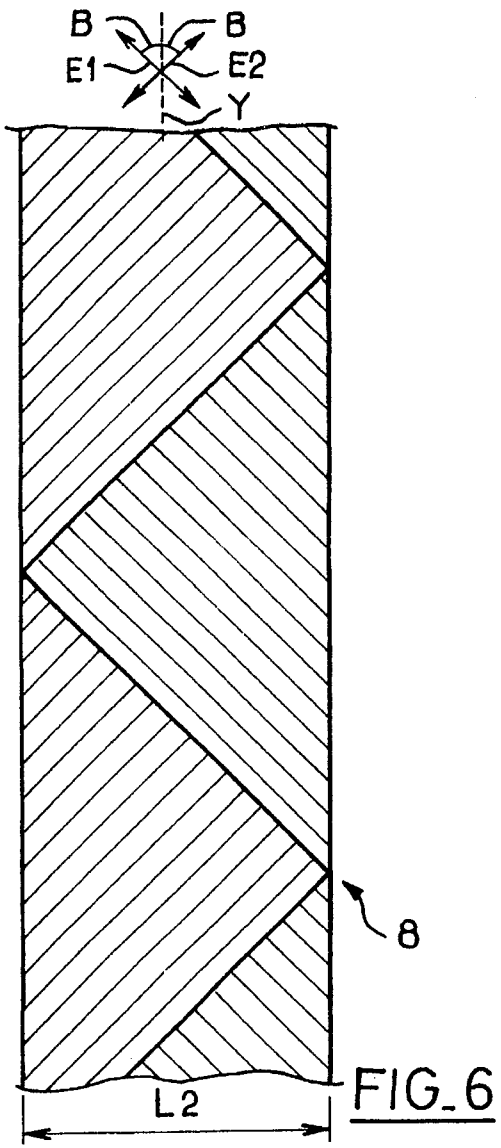
FIGS. 4 to 6 are schematic views showing the privileged orientations of the fibers in the textile product at different stages of manufacture.
Figure 2:
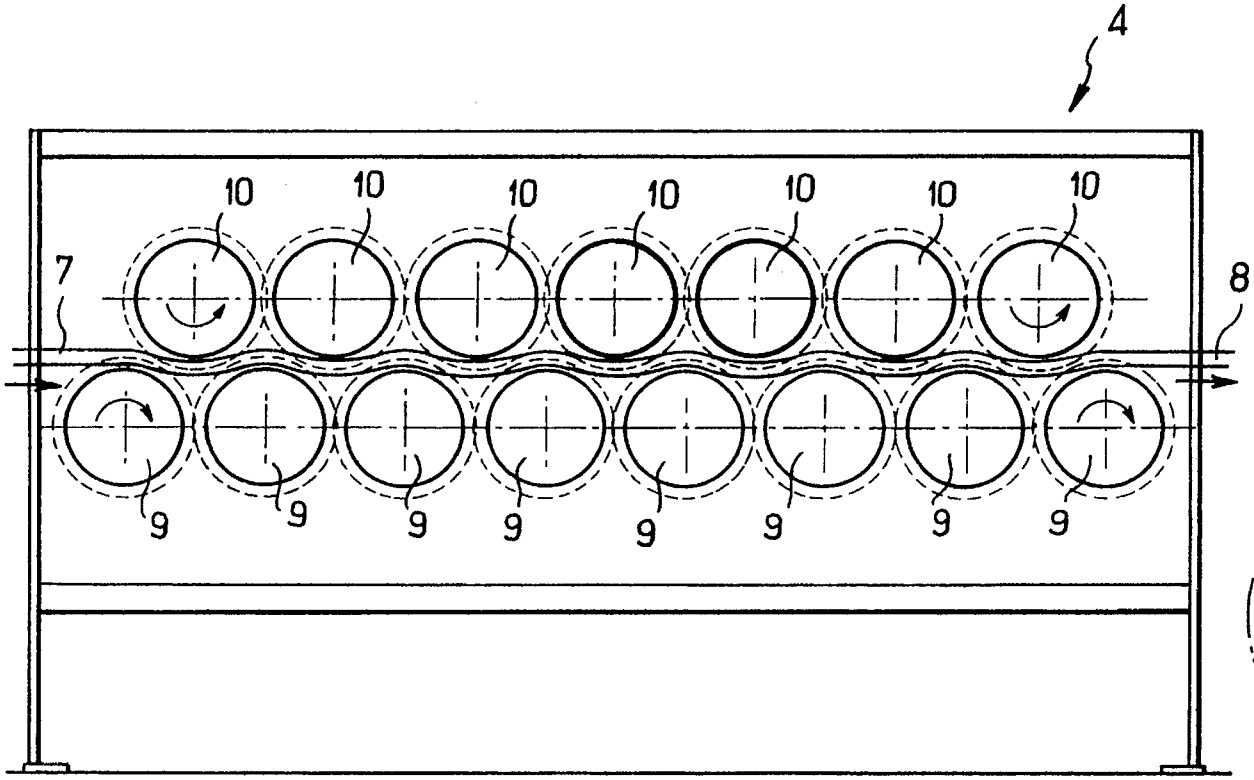
FIG. 2 is a schematic view in elevation of the interior of a drawing frame which forms part of the installation of FIG. 1.

At the exit of the selvedge-teaser 3, the lap 7 is introduced into the drawing frame 4, the exit end of which delivers the semifinished nonwoven product 8 (FIG. 6). As shown in FIG. 2, the lap-drawing frame 4 has rotating rollers 9, 10 disposed successively along the path of transfer of the lap during the drawing operation. These rollers 9, 10 are placed alternately above and beneath the lap which is being drawn-out. Said rollers 9, 10 are driven in rotation so as to cause the lap to advance along the drawing frame 4. Each roller 9, 10 is driven in rotation at a speed equal to or higher than that of the preceding roller along the path of travel of the lap. By adjusting the difference in speed between the successive rollers 9, 10 (typically between 0 and 100%), one adjusts the degree of draft of the lap 7 within the drawing frame 4. The number of rollers 9, 10 can vary from five to thirty. The total degree of draft can amount to 800%.

Figure 3:
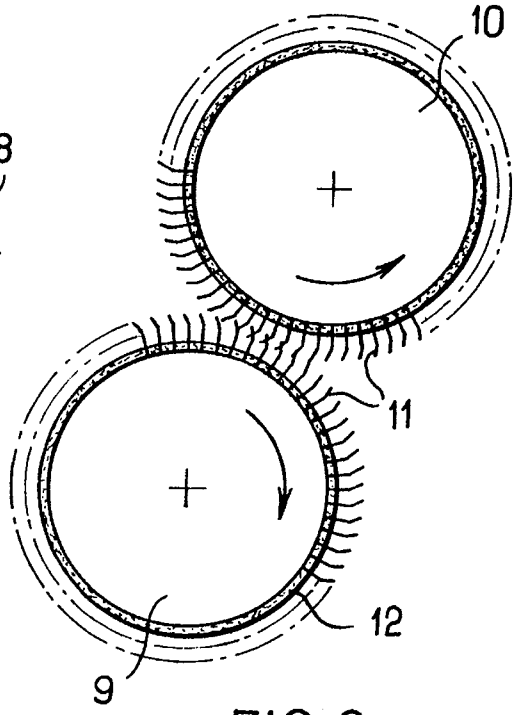
FIG. 3 is a view in elevation showing a detail of FIG. 2.

With reference to FIG. 3, it is seen that the rollers 9, 10 are provided at their periphery with a covering in which are set teeth 11. The teeth 11 of the covering are flexible. To this end, they can be in the form of wire teeth fixed on a textile base 12 which surrounds the roller 9, 10. In the example shown in FIG. 3, the flexible teeth 11 extend in a substantially radial direction with respect to the rollers 9, 10 and have an end portion which is elbowed (at an angle of 10°, for example) towards the rear with respect to the direction of rotation of the roller 9, 10. The teeth 11 carried by two successive rollers 9, 10 interpenetrate to a certain length so that, when the lap travels between these two successive rollers, the teeth 11 penetrate to the heart of the lap.

The majority orientations (E1, E2) of the fibers which constitute the drawn product 8 are shown diagrammatically in FIG. 6. The orientations of the fibers in the product 8have been modified by the drawing operation and the fibers issuing from contiguous sections of web of the non-drawn lap 7 have to some extent been interlocked as a result of penetration of the teeth 11 into the heart of the lap during the drawing operation. FIG, 6 illustrates the product 8 made up of successive inclined sections of web but it will be observed that, for the sake of enhanced clarity of the figure, this schematic illustration exaggerates the sharpness of outline of the structure of the product 8 which is homogenized by the interengagement of the fibers. Owing to the structure of the covering of the rollers 9, 10 of the drawing frame 4, the lap is subjected to very slight transverse shrinkage during the drawing operation, with the result that the width L2 of the drawn product 8 is substantially equal to that of the lap 7 prior to drawing.

The degree of draft within the drawing frame 4 is so adjusted that the fibers within the drawn product 8 are for the most part distributed in two orientations E1, E2 which are substantially symmetrical with respect to the longitudinal direction Y of the drawn product 8 and form with this direction an angle B within the range of 30° to 60° . In the example illustrated in FIG. 6, the drawing frame 4 has been so adjusted that said angle B is approximately 45°, which represents a preferred value for optimizing the homogeneity of the product.

The semifinished product 8 thus obtained has a resistance in the longitudinal direction which is of the same order of magnitude as the resistance to pulling stress in the transverse direction. If the drawing frame 4 is so adjusted that the degree of draft is increased in order to obtain an angle B of less than 45° between the majority orientations E1, E2 and the longitudinal direction Y, it is possible to obtain a product having a resistance to pulling stress (tensile strength) which is higher in the longitudinal direction Y than in the transverse direction.

The semifinished product 8 has sufficient cohesion to be coiled directly on a roller 5 as it passes out of the drawing frame 4. The semifinished product 8 can thus advantageously be stored in a coiled form.

At the exit of the drawing frame 4, the drawn product 8 can also be subjected to a treatment by heat-setting, water jet, impregnation, needle-punching, incorporation of a chemical binder, spraying, ultrasonic treatment, tufting or sewing of fibers.

The semifinished product 8 advantageously has a weight per unit area which is lower than 50 g/m$^2$ and preferably lower than 30 g/m$^2$. It is possible for example to obtain a semifinished product 8 having a weight per unit area of 20 g/m$^2$ starting from a web 6 of 30 g/m$^2$ folded to four thicknesses so as to form a lap 7 of 120 g/m$^2$ prior to drawing.

The semifinished product in accordance with the invention can for example be employed for supplying a device for the manufacture of textile products of the type described in patent document FR-A-2,649,130.

As will readily be apparent, various modifications can be made in the particular examples described in the foregoing without thereby departing from the scope of the present invention.

Thus teasing of the edges of the product may indifferently be performed either before or after drawing. The selvedge-teaser 3 shown in FIG. 1 upstream of the drawing frame 4 can therefore also be placed downstream of the frame.

We claim:

1. A method of manufacturing a semifinished nonwoven product (8), comprising the steps of:

providing discontinous fibers to a card (1);

producing a carded web (6) from the fibers;

delivering the web (6) from the card (1) in a longitudinal direction; a majority of the discontinuous fibers within the web (6) being distributed in a direction parallel to the longitudinal direction;

feeding the web (6) to a crosslapping unit (2);

folding the web (6) into the crosslapping unit (2) so as to obtain a lap (7) having a chosen width (L2) as measured perpendicularly to the longitudinal direction (Y) and including a chosen number of layers of crosslapped web (6); the majority of the discontinuous fibers in the lap (7) being distributed in two directions (D1; D2) symmetrical and oriented with a first angle (A) comprised between 75° C. and 90° C. with respect to the longitudinal direction (X) of the lap (7) delivered by the crosslapping unit (2);

providing the lap (7) to a drawing frame (4) including two series of rollers (9, 10) rotated with an increasing velocity in the longitudinal direction and each covered with flexibly mounted radial needle-like teeth (11), the teeth (11) of a series of rollers (9, 10) overlapping the teeth (11) of the other series of rollers (10, 9);

passing the lap (7) between the two series of rollers in such a manner that the teeth (11) of the rollers penetrate the heart of the lap (7) which is drawn to obtain a semifinished nonwoven product (8);

adjusting a degree of drafting so that in a whole thickness of the product (8) the majority of the discontinuous fibers are pivoted about the teeth (11) in such a manner that the first angle (A) is changed to a second predetermined angle (B) comprised between 30° C. and 60° C. with respect to the longitudinal direction (Y), of the two symmetrical directions (E1; E2) of the majority of the discontinuous fibers in the drawn product (8), the second angle (B) is chosen so as to obtain a predetermined resistance to pulling stress of the drawn product (8), and a width (L2) of the product (8) as measured perpendicularly to the longitudinal direction (Y) is substantially equal to the corresponding width (L2) of the lap (7) before drawing.

2. A method according to claim 1, wherein the degree of draft is so adjusted that the majority orientations (E1, E2) of the fibers within the drawn product (8) form with its longitudinal direction (Y) a said second angle (B) substantially equal to 45° C.

3. A method according to claims 1 wherein the edges of the lap (7) are teased before or after drawing.

4. A method according to claim 1, wherein the drawn product (8) is coiled immediately after it has been drawn-out so as to form a semifinished product which can be uncoiled for subsequent processing.

5. A method according to claim 1, wherein at the exit of the drawing frame, the drawn product (8) is subjected to a treatment selected from the group comprising heat-setting, water jet, impregnation, needle-punching, incorporation of a chemical binder, spraying, ultrasonic treament, tufting and sewing of fibers.

6. A nonwoven semifinished product (8) obtained by the method according to claim 1, wherein a majority of the fibers (E1; E2) are oriented at an angle which is substantially equal to 45° C. with respect to the longitudinal direction (Y) of the product (8).

7. A nonwoven product according to claim 6, wherein a resistance of said nonwoven product to pulling stress is higher in the longitudinal direction (Y) than in the transverse direction.

8. A nonwoven product according to claim 7, wherein said product is stored in a coiled form.

9. A nonwoven product according to claim 7, wherein a weight of said nonwoven product per unit area is lower that 50 g/m$^2$.

* * * * *